United States Patent [19]

Davis et al.

[11] 4,235,599

[45] Nov. 25, 1980

[54] BLEACHING COMPOSITION

[75] Inventors: Thomas B. Davis, Cos Cob; Theodore A. Girard, Bridgeport, both of Conn.

[73] Assignee: Glyco Chemicals, Inc., Greenwich, Conn.

[21] Appl. No.: 911,190

[22] Filed: May 30, 1978

[51] Int. Cl.[2] ..... D06L 3/06

[52] U.S. Cl. ..... 8/108 R; 252/95; 252/99; 252/187 H

[58] Field of Search ..... 252/95, 99, 187 H; 8/108 R

[56] References Cited

U.S. PATENT DOCUMENTS

| | | | |
|---|---|---|---|
| 2,938,764 | 5/1960 | Bromfield | 252/95 X |
| 3,503,884 | 3/1970 | Chirash et al. | 252/95 |
| 3,519,569 | 7/1970 | Diaz | 252/95 X |
| 3,577,347 | 4/1971 | Monick | 252/99 X |
| 3,700,401 | 10/1972 | Spangler et al. | 252/99 X |
| 3,850,833 | 11/1974 | Koceich | 252/95 X |
| 3,966,627 | 6/1976 | Gray | 252/95 X |

*Primary Examiner*—Mayer Weinblatt

*Attorney, Agent, or Firm*—Cushman, Darby & Cushman

[57] ABSTRACT

An improved bleaching agent composition is described composed of a mixture of N,N-dichloro-substituted hydantoin compounds with sodium bromide, which has enhanced bleaching effectiveness for textile materials, particularly in laundry systems, when used at lower-than-normal washing temperatures, e.g., in the range of about 100° to 140° F.

6 Claims, 1 Drawing Figure

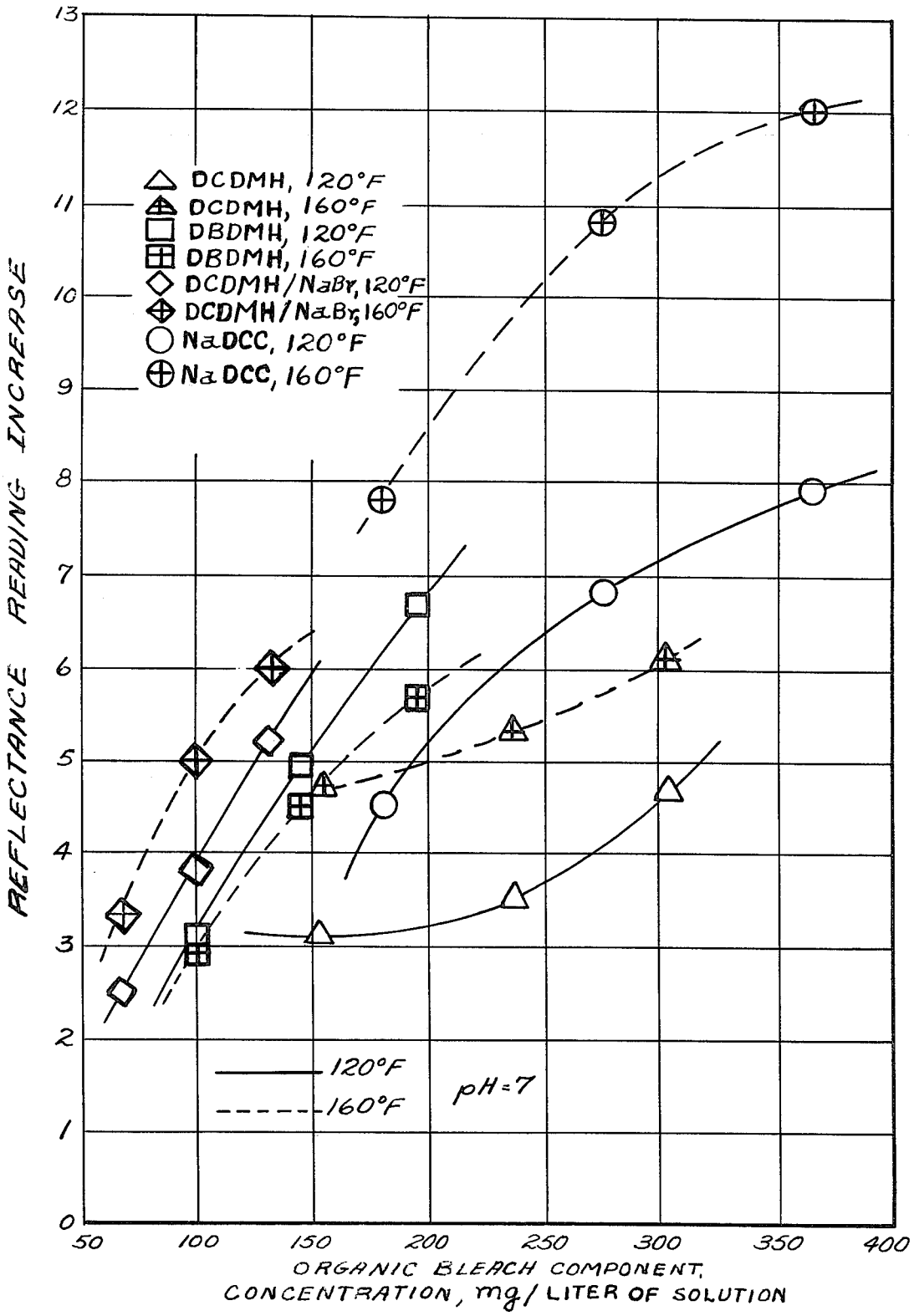
DCDMH, 120°F
DCDMH, 160°F
DBDMH, 120°F
DBDMH, 160°F
DCDMH/NaBr, 120°F
DCDMH/NaBr, 160°F
NaDCC, 120°F
NaDCC, 160°F
120°F
160°F
pH=7
REFLECTANCE READING INCREASE
ORGANIC BLEACH COMPONENT, CONCENTRATION, mg/LITER OF SOLUTION
0
1
2
3
4
5
6
7
8
9
10
11
12
13
50
100
150
200
250
300
350
400

BLEACHING COMPOSITION

This invention relates to an improved bleaching agent composition for use in aqueous systems, such as in laundry operations or in the commercial processing of textile materials, e.g., cotton grey goods.

The use of halogen-releasing agents for bleaching as well as disinfecting purposes in the processing or laundering of textile materials is, of course, well known, and has a long history. Various inorganic halogen-based bleaching agents are known including not only elemental chlorine gas, but also sodium hypochlorite, sodium hypobromite, etc. In addition, a number of halogen-releasing organic agents have been disclosed as bleaching agents. These include, for instance, halogenated glycourils described in U.S. Pat. No. 3,071,591 and a number of other N-halogenated derivatives of amines, amides, imides and various N-heterocyclic compounds, such as those mentioned in U.S. Pat. No. 3,412,021.

Included in such known N-halogenated organic compounds are the N,N-dihalo-substituted hydantoin compounds. It is with respect to the latter class of organo N-halogenated materials that the present invention is particularly concerned.

Characteristically, in previous years, bleaching agents for use in the laundering or processing of textile materials were employed in practice at relatively elevated temperatures of, for instance, above about 160° F. (approx. 70° C.). For some years, however, there has been an interest in the processing of textiles in a bleaching environment at lower temperatures—dictated in part from the standpoint of energy conservation measures, and in part from the standpoint of protecting the textile material against chemical damage. At such lower temperatures, however, many of the most commonly used and hitherto satisfactory bleaching agents lose a substantial amount of their activity. Consequently, such agents have either failed or have had to be used in significantly larger quantities in order to achieve useful bleaching effectiveness at these lower temperatures.

For instance, one of the most valuable current commercial bleaching agents is sodium dichloroisocyanurate and is highly effective at temperatures above about 160° F. However, if used at temperatures of only, say, 120° F. (about 49° C.) this material may require twice or more the concentration, to achieve comparable bleaching effects. Such an increased amount of bleaching agent not only adds to the cost of the bleaching operation (thereby at least partially nullifying the lower-temperature energy-saving advantage desired) but also adds to the amount of pollutants in the effluent water discharged from such operations.

There has consequently existed for some time a need for improved bleaching agents which can be effectively used at the desired lower processing temperatures. It is a principal object of this invention to provide such an improved bleaching composition, and which also offers a decrease in the amount of organic bleaching additive required for the purpose (thereby decreasing effluent contaminant problems), and with cost saving advantages.

According to the present invention, an improved bleaching composition is provided which, in its preferred form, consists essentially of the combination of a 5,5-di-substituted-N,N-dichloro hydantoin component together with sodium bromide. In part, the present invention resides in the unexpected discovery that such combination of the chlorinated hydantoin compound with sodium bromide leads to an unexpected potentiation of the bleaching activity than would otherwise be expected from use of the N,N-dichloro hydantoin alone.

It will be recognized by those skilled in the art, of course, that the bleaching action of N-halogenated organic compounds is thought to be due to the release of positive halogen ions which are themselves powerful oxidizing agents and act as the effective bleaching agent. It is also generally considered that positive bromine ions are more powerful and effective bleaching agents than positive chlorine ions. However, N-bromo-substituted organic compounds are characteristically more expensive than N-chloro-substituted organic compounds. Thus, the use of such brominated compounds has not been and is not as attractive as using the corresponding chlorinated compound from a cost consideration point of view, provided that adequate bleaching effectiveness could be realized from the chlorinated material.

It has been observed, as in the tests described hereinafter, that N,N-dichloro hydantoin compounds are themselves relatively ineffective as bleaching agents particularly at the lower temperatures of, for instance, 120° F. (approx. 50° C.) desired for today's bleaching operations, and not even very effective as a bleaching agent at higher temperatures of, for instance, 160° F., and above (particularly at reasonable concentration levels). This is the marked contrast to the behavior of N,N-dibromo-substituted hydantoins which are nearly as effective at 160° F. as they are at 120° F., on a weight-for-weight basis. Indeed, relatively speaking, the activity of the N,N-dichloro substituted hydantoins declines even more severely, with a lower temperature, than is experienced with the presently used sodium dichloroisocyanurate.

It is thus not to have been expected that at the desired lower temperatures the N,N-dichloro-substituted hydantoins would function as effective bleaching agents, even in combination with the sodium bromide component because the lower temperatures appear to be below the required level for oxidizing effectiveness of the dichloro hydantoin material.

It is believed that in the practice of the present invention, and the use of the composition herein described and provided, the N,N-dichloro hydantoin compound component interacts with the sodium bromide component to form positive bromide ions. Such positive bromide ions then act as oxidizing agents for the organic, or inorganic, stains, or other discolorations to be removed from the textile. In such process the positive bromide ions are themselves chemically reduced back to the negative bromide ions. Such re-formed negative bromide ions are thus susceptible again to oxidation to new positive bromide ions, as a result of interaction with additional molecules of the dichloro hydantoin compound. The entire process thus repeatedly reoccurs until the dichloro hydantoin component is itself completely consumed. Assuming the above explanation is accurate for the operation of the present invention, it was thus not known heretofore that in the complex heterogenous systems of, for instance, a conventional load of laundry, that the desired course of the reaction would occur in substantial preference to the multitude of possible competing reactions which might take place.

Moreover, when the hydantoin weight component of the present composition (including the sodium bromide) is compared to the weight required of the corresponding dichloro hydantoin, if used alone, to reach equivalent bleaching results, it is observed that equivalent bleaching effectiveness is realized with only about 35% to 45% of hydantoin compound.

Since the present invention utilizes the relatively inexpensive sodium bromide salt as a substantial amount of the bleaching composition provided herein (even above 50% by weight), cost advantages can be readily realized. Moreover, since the relative amount of organic material is also reduced, effluent polluting problems can also be minimized.

Comparing a dichloro-hydantoin/sodium bromide results with those using the corresponding dibromohydantoin (which is itself not potentiated at all by sodium bromide) on a weight-for-weight basis, it also appears, quite unpredictably, that the bleaching power of the potentiated dichloro hydantoin actually exceeds that of an equal weight amount of the dibromo hydantoin.

Even when the comparison made on an equivalent "available" halogen basis, i.e., the dibromo hydantoin with an equal molar amount of the dichloro hydantoin, it is still seen that the bleaching effectiveness of the latter when used with sodium bromide is above about 80% of the dibromo compound, depending somewhat upon concentration.

The term "available halogen", as used herein, is a term established for comparing a potential bleaching or disinfecting power of halogen atoms with that of the elemental halogen on a weight basis. Elemental halogen is defined as containing 100% "available" halogen. However, since in an aqueous bleaching operation elemental halogen is, in the chemistry of the system, converted to both the hydro-halogen acid (negative halogen ion) and the hypohalogen acid (positive halogen ion) actually only one-half of the total halogens present in the diatomic elemental molecule are available for bleaching (i.e., oxidizing to power). Accordingly, when a component is under consideration which in fact releases a positive halogen ion, the "available" halogen rating such compound is in fact twice the actual weight percent of such halogen in its molecular formula.

At the same time, the compositions of the present invention appear to leave substantially intact the optical brighteners, typically in a detergent composition, for their desired effect on the appearance of the finished laundry, and it is also not seen that there is a deteriorative effect on the fabric itself.

These latter beneficial effects may be realized because the reaction of the dichloro hydantoin compound with the sodium bromide has a finite kenetic rate such that the actual release of the oxidizing positive bromide ions into the system takes place over a period of time during the bleaching operation. This effect might be expected to lead to milder bleaching effects; however, even though that may be the case, the results as hereinafter described demonstrate that the desired bleaching effects are still in fact obtained.

The practice and effectiveness of the present invention is illustrated by the following tests wherein unbleached cotton muslin was washed with a control detergent, AATCC Standard 124. The machine used was a Terg-O-Tometer (60 cpm) with distilled water and a washing time of 10 minutes, followed by a 5 minute rinse cycle and two cold water hand rinses. To measure the bleaching effectiveness, the light reflectance of the fabric was measured before and after each wash with a Photovolt reflectometer equipped with a blue filter. The results are recorded as an increase in the light reflectance of the dry samples.

The test procedure was as follows.

The standard detergent (2.5 grams/liter of water) was used with varying concentrations (per liter) of the bleaching agents, as listed hereinbelow.

Sodium dichloroisocyanurate (NaDCC) was used as a standard for comparison purposes; N,N-dichloro 5,5-dimethyl hydantoin (DCDMH) and N,N-dibromo 5,5-dimethyl hydantoin (DBDMH) was also used for comparison purposes. A mixture, representative of the invention of DCDMH and sodium bromide (DCDMH/NaBr) was also used, in which the weight percent of DCDMH was 48.8%. Each component was employed at three concentration levels, the same having been calculated so that at each respective level an equivalent amount of "available" halogen was present in the organic component.

The washing cycle was conducted, as indicated above, at a water temperature of 120° F. (48.9° C.), at a pH of 7 (adjusted by the use of dilute sulfuric acid and sodium carbonate). The results of the reflectance readings, measured as described above, are tabulated below.

TABLE 1

| (120° F.; pH = 7) | | |
|---|---|---|
| Ingredient | Conc. mg/liter | Increase In Reflectance Reading |
| NaDCC | 364 | 7.9 |
| NaDCC | 273 | 6.8 |
| DBDMH | 192 | 6.7 |
| DCDMH/NaBr | 270 | 5.2 |
| DBDMH | 144 | 4.9 |
| DCDMH | 303 | 4.7 |
| DCDMH/NaBr | 203 | 3.8 |
| DCDMH | 227 | 3.3 |
| DCDMH | 152 | 3.1 |
| DBDMH | 96 | 3.1 |
| DCDMH/NaBr | 135 | 2.5 |
| Control | | 0.73 |

The "Control" represents the results when the standard detergent alone was used.

Another test was also conducted by the same procedure described above, again with the water temperature at 120° F., but the pH of the washing solution having been adjusted to 10. Again, the results of the tests for the respective concentrations are listed below in Table 2.

TABLE 2

| (120° F.; pH = 10) | | |
|---|---|---|
| Ingredient | Conc. mg/liter | Increase In Reflectance Reading |
| NaDCC | 364 | 4.4 |
| NaDCC | 273 | 4.0 |
| DCDMH/NaBr | 270 | 3.5 |
| NaDCC | 182 | 3.1 |
| DCDMH | 303 | 3.0 |
| DBDMH | 192 | 2.9 |
| DCDMH/NaBr | 203 | 2.9 |
| DCDMH | 227 | 2.7 |
| DBDMH | 144 | 2.4 |
| DCDMH/NaBr | 135 | 2.4 |
| DCDMH | 152 | 2.2 |
| DBDMH | 96 | 2.0 |
| Control | | 0.65 |

Still another test was conducted using the procedure described again but this time with a water temperature of 160° F. (71° C.), and at a pH of 7. The results of this test for the respective concentrations of the materials employed are listed below in Table 3.

TABLE 3

(160° F.; pH = 7)

| Ingredient | Conc. mg/liter | Increase In Reflectance Reading |
|---|---|---|
| NaDCC | 364 | 12.0 |
| NaDCC | 273 | 10.8 |
| NaDCC | 182 | 7.8 |
| DCDMH | 303 | 6.1 |
| DCDMH/NaBr | 270 | 6.0 |
| DBDMH | 192 | 5.7 |
| DCDMH | 227 | 5.3 |
| DCDMH/NaBr | 203 | 5.0 |
| DCDMH | 152 | 4.7 |
| DBDMH | 144 | 4.5 |
| DCDMH/NaBr | 135 | 3.3 |
| DBDMH | 96 | 2.9 |
| Control | | 0.80 |

A fourth test was conducted, again following the above procedure, but using water adjusted to a pH of 10 and a temperature of 160° F. The reflectance reading increase results obtained are listed in Table 4.

TABLE 4

(160° F.; pH = 10)

| Ingredient | Conc. mg/liter | Increase In Reflectance Reading |
|---|---|---|
| NaDCC | 364 | 4.7 |
| NaDCC | 273 | 4.1 |
| NaDCC | 182 | 3.2 |
| DCDMH | 303 | 3.2 |
| DBDMH | 192 | 2.5 |
| DCDMH/NaBr | 270 | 2.5 |
| DCDMH | 227 | 2.4 |
| DCDMH/NaBr | 203 | 2.4 |
| DCDMH/NaBr | 135 | 2.1 |
| DCDMH | 152 | 1.8 |
| DBDMH | 144 | 1.7 |
| DBDMH | 96 | 1.4 |
| Control | | 0.85 |

From these data it will be seen that the dichloro hydantoin/sodium bromide combination exhibits a far greater relative bleaching effectiveness than the dichloro hydantoin used alone. To interpret these data it should also be appreciated that each of the respective concentrations of the DCDMH used alone and of the NaDCC provides an equivalent "available" chlorine concentration. That is, e.g., 227 mg of the DCDMH provides the same number of chlorine atoms as 273 mg of the NaDCC (calculated as the dihydrate). This is also true for the DCDMH concentrations, used in the admixture with NaBr, with respect to the amounts of DBDMH employed (e.g., the three DCDMH concentrations thus used, 66 mg, 99 mg, 132 mg, respectively (provide the same number of halogen atoms as do 99, 144 and 192 mg of DBDMH).

To further illustrate the advantage of the invention, these data for a pH of 7 are graphically portrayed in the attached FIGURE wherein the solid curves connect data points measured at 120° F. and the dashed curves connect data points measured at 160° F. in the above tests. The data is plotted on the basis of the concentration of the organic bleaching agent present.

It is readily seen therefrom that used by itself DCDMH (the triangular points) is, comparatively speaking, a rather ineffective bleach used at 120° C. However, when used in combination with sodium bromide, it is even more effective than the dibromo dimethyl hydantoin, on a weight-for-weight basis. For instance, to obtain a reflectance reading increase of 5, a concentration of approximately 115 mg per liter of the DCDMH, in combination with sodium bromide, is sufficient, whereas for the same increase in reflectance reading a concentration approximately 145 mg of DBDMH is necessary, i.e., 26 weight percent more. As noted above, even when these relative amounts are considered on an equivalent "available" halogen basis, the bleaching effectiveness of the DCDMH is some 80% of that of the DBDMH, when the former is used in combination with sodium bromide. In absence of sodium bromide, at 120° F. and a pH of 7 the DCDMH is only about 30% as effective as DBDMH, on the same basis.

For the data at pH of 10 in the above Tables, it can also be seen that the combination with NaBr greatly potentiates the bleaching effect of DCDMH, however, the bleaching effectiveness of all materials is depressed under these alkaline conditions.

Of course, this invention is not limited to the use of N,N-dichloro 5,5-dimethyl hydantoin. In general, other alkyl groups may be present in place of the methyl groups, as desired, up to, for instance, lower alkyl groups of 8 carbon atoms. The N,N-dichloro hydantoin parent compound may also be used. No significant advantage is, however, seen from using alkyl groups larger than the methyl group because the resulting increased molecular weight would simply require the addition of more organic material to the system for an equivalent bleaching activity. The dimethyl-substituted hydantoin is also the presently preferred material from a standpoint of cost and availability.

Other sources of the bromide ion besides sodium bromide may also be employed, for instance, the other alkali or alkaline earth metal or ammonium bromide salts (e.g., K Br, CsBr, $MgBr_2$, $CaBr_2$, etc.). In general, it is not a cation associated with the bromide ion that is of significance of the invention; rather, the bromide ion may be derived from any desired non-interfering source.

Further, the invention is not limited to the use of approximately 50:50 weight mixtures of the hydantoin and bromide components in the composition. Considering the N,N-dichloro dimethyl hydantoin and sodium bromide combination, weight ratios in the range of at least 25:75 up to 75:25, preferably 40:60 up to 60:40, be employed. Similar proportions may also be used, calculated on a basis of available chlorine on the one hand and bromide ion on the other hand when other hydantoins and bromide salts are employed.

The composition of choice will, of course, be dictated as a practical matter by considerations of cost balanced against bleaching effectiveness. Currently, sodium bromide is available at a cost level of approximately 50% of DCDMH, and the cost of NaDCC is between 20% and 35% higher than that of DCDMH. From these proportions it can be seen that the cost of a DCDMH/NaBr combination for equivalent bleaching results can be significantly less than the cost of NaDCC which is currently so extensively used. This is especially true at the lower wash temperatures, now desired, whereat the activity of NaDCC falls so rapidly as shown in the accompanying FIGURE.

Furthermore, significantly less organic material will then be present in the effluent from a laundry or bleaching system when using the composition of the present invention as compared to the amount which would be introduced if NaDCC were used at an equivalent level of bleaching effectiveness.

While the foregoing Examples illustrate the particular advantages of the invention at washing temperatures of 120° F., it will also be appreciated that similar effects will be realized at other temperatures, ranging from about 80° F. up to about 140° F., the precise level thereof depending upon the particular composition and conditions employed. Of course, the technological effectiveness of the invention is also demonstrated at even higher temperatures, such as at 160° F., although from a cost-effective standpoint the present compositions are not, at present, competitive with other existing bleaching systems.

What is claimed is:

1. A method for the effective bleaching of textile goods at temperatures in the range of 100° to 140° F. which consists essentially in exposing the same to an aqueous solution, at said temperatures, containing a mixture consisting essentially of 25 to 75 parts by weight of N,N-dichloro-5,5-dilower alkyl hydantoin and from 75 to 25 parts by weight of an alkali metal, alkaline earth metal or ammonium bromide salt, said dilower alkyl containing up to 8 carbons.

2. The method of claim 1, wherein said salt is an alkali metal bromide.

3. The method of claim 1, wherein said hydantoin is present in an amount of from 40 to 60 parts by weight and wherein said salt is present in an amount of from 60 to 40 parts by weight.

4. The method of claim 1 wherein said bromide salt is selected from the group consisting of K Br, CsBr, $MgBr_2$ and $CaBr_2$.

5. The method of claim 1 wherein said bromide salt is sodium bromide.

6. The method of claim 5 wherein said hydantoin is N,N-dichloro-5,5-dimethyl hydantoin.

* * * * *